United States Patent [19]

Ott

[11] Patent Number: 5,005,333

[45] Date of Patent: Apr. 9, 1991

[54] PANEL-FRAMING ASSEMBLY AND ASSEMBLY METHOD THEREFOR

[76] Inventor: Donald E. Ott, 17754 W. Spring Lake Rd., Spring Lake, Mich. 49456

[21] Appl. No.: 491,082

[22] Filed: Mar. 9, 1990

[51] Int. Cl.[5] ..... E04B 9/00

[52] U.S. Cl. ..... 52/476; 52/766; 52/775

[58] Field of Search ..... 52/475, 476, 824, 825, 52/771, 775, 766; 49/501

[56] References Cited

U.S. PATENT DOCUMENTS

| | | | |
|---|---|---|---|
| 3,233,381 | 2/1966 | Wedel | 52/476 X |
| 3,527,011 | 9/1970 | Bloom et al. | 52/476 X |
| 3,688,458 | 9/1972 | Inmon et al. | 52/766 X |
| 3,751,865 | 8/1973 | Brigham | 52/775 X |
| 3,964,225 | 6/1976 | Yoshida | 52/766 |
| 3,995,405 | 12/1976 | Peterson | 52/476 X |
| 4,580,385 | 4/1986 | Field | 52/775 X |
| 4,873,803 | 10/1989 | Rundo | 52/775 X |

*Primary Examiner*—Philip C. Kannan

*Attorney, Agent, or Firm*—Dressler, Goldsmith, Shore, Sutker & Milnamow, Ltd.

[57] ABSTRACT

A panel-framing assembly using clips to secure a pair of retaining strips to a frame member, along each edge of a panel being framed, without any adhesive. Each clip has a securing portion, which is insertable into a relatively wide region of a slot in a wall of the frame member, and which is adapted to coact with the wall to secure such clip to the frame member when such clip is moved so that the securing region is admitted by a relatively narrow region of the slot. Each retaining strip has an inner leg, which is insertable between a flanged portion of each clip and the wall when such clip is secured to the wall, and an outer leg, which is generally normal to the inner leg, and which is adapted to retain a panel seated against the flanged portion by engaging a portion of one face of the panel along one edge of the panel to prevent lateral movement of the panel relative to the frame member.

11 Claims, 2 Drawing Sheets

APPROVED BY O.G. FIG. CLASS

PANEL-FRAMING ASSEMBLY AND ASSEMBLY METHOD THEREFOR

TECHNICAL FIELD OF THE INVENTION

This invention pertains generally to framed panels, as used in office partitions, office consoles, and similar structures, and particularly to a panel-framing assembly having improved features.

BACKGROUND OF THE INVENTION

Framed panels made predominantly of wood, wood byproducts, such as presswood or particle board, or other structural materials and framed panels made predominantly of sound-absorbing materials are used widely in office consoles, office partitions, and similar structures Office consoles are exemplified by telemarketing consoles, which may be equipped with telephones, computer terminals, and other telemarketing equipment.

Typically, such a panel is rectangular and is framed by a panel-framing assembly comprising frame members extending along the respective edges of the panel, corner connectors connecting the frame members at the respective corners of the panel-framing assembly, and retaining or molding strips. The retaining or molding strips retain the panel, along its respective edges, and conceal any minor flaws along the respective edges of the panel.

Commonly, the frame members are made from metal tubing with a generally rectangular cross-section. The cross-section of such tubing may be generally square. Commonly, the retaining or molding strips are extruded from a polymeric material.

In such a panel-framing assembly, the retaining or molding strips must be adequately secured to the frame members, along the respective edges of the panel. One way to secure the retaining or molding strips is disclosed in Peterson U.S. Pat. No. 3,995,405. As disclosed therein, the retaining or molding strips on a given side of the panel have a particular shape and are secured adhesively to the frame members, and the retaining or molding strips on the other side of the panel have a complementary shape and are secured mechanically to the adhesively secured strips.

A disadvantage of securing a retaining or molding strip adhesively to a frame member is that the strip to be adhesively secured must be precisely positioned along and between opposite sides of the frame member. Another disadvantage is that the adhesively secured strip cannot be easily removed when it is desired to repair, rearrange, or disassemble the panel-framing assembly.

Hence, there has been a need, to which this invention is addressed, for an improved way to secure the retaining or molding strips to the frame members.

SUMMARY OF THE INVENTION

This invention provides an assembly for framing a panel, such as a panel made predominantly of wood or of another structural or sound-absorbing material. Such a panel framed by the panel-framing assembly provided by this invention is useful in an office partition, in an office console, such as a telemarketing console, or in a similar structure.

Broadly, the panel-framing assembly provided by this invention comprises and is assembled from a frame member, one or more clips, and a retaining strip or a pair of retaining strips. The panel-framing assembly provided by this invention may be easily but securely assembled without any adhesive. The frame member has a wall defining an opening for such clip.

Each clip has a securing portion, which is insertable into the opening for such clip. Each clip is adapted to coact with the frame member wall to secure the clip to the frame member, after the securing portion of such clip has been inserted into the opening. Each clip has a flanged portion confronting the wall, in spaced relation to the wall.

Each retaining strip has an inner leg and an outer leg, which is generally normal to the inner leg. When inserted between the flanged portion of each clip and the wall, the inner leg is adapted to coact with the flanged portion of the clip to secure the retaining strip to the frame member. The outer leg is adapted to retain a panel that has been seated against the flanged portion of each clip, by engaging a portion of one face of the panel along one edge of the panel to prevent lateral movement of the edge in one direction relative to the frame member.

It is preferred that the securing portion of each clip is insertable into the opening for the clip to place the clip in a first position relative to the frame member and so that the clip is movable from the first position to a second position relative to the frame member while the securing portion remains inserted in the opening. It is preferred that the securing portion of each clip is adapted to coact with the wall of the frame member to secure the clip to the frame member in the second position.

Preferably, if each clip is movable in a manner described above, the securing portion of such clip includes at least one securing flange, preferably a pair of securing flanges, and a web connecting the securing flange or securing flanges to the flanged portion of the clip. If a pair of securing flanges are included, the securing flanges extend respectively from opposite sides of the web. Preferably the opening for each clip is constituted by a slot extending longitudinally along the wall of the frame member and having a relatively wide region and a relatively narrow region, which extends longitudinally from the relatively wide region. The relatively wide region is dimensioned to admit the securing flange or securing flanges of a clip when the securing portion of the clip is inserted into the relatively wide region in a direction normal to the wall. The relatively narrow region is dimensioned to admit the web when the same clip is moved longitudinally along the wall from the first position to the second position in which each securing flange confronts the wall on one side of the relatively narrow region.

In a preferred construction, the wall of the frame member mounts two or more similar clips, and two or more similar openings are provided, one opening for each clip. Moreover, the flanged portion of each clip comprises a pair of seating flanges confronting the wall, in spaced relation to the wall. Furthermore, each seating flange has a locking rib.

In the preferred construction, a pair of retaining strips are provided. Also, the inner leg of each retaining strip has an interlocking rib, which is adapted to coact with the locking rib of a respective one of the seating flanges of each clip to secure such retaining strip to the frame member. The outer leg of each retaining strip is adapted to retain a panel seated against the clip seating flanges by engaging a portion of one face of the panel, along one edge of the panel, to prevent lateral movement of the edge in one direction relative to the frame member.

Four sections of the panel-framing assembly described above may be advantageously assembled with four corner connectors of a known type for framing a rectangular panel. The retaining strips retain the panel, along its respective edges, and conceal any minor flaws along the respective edges of the panel.

Thus, in a presently preferred method according to this invention for framing a rectangular panel, a frame member having a wall defining a series of similar openings, as described above, a plurality of similar clips, each as described above, and a pair of retaining strips, each as described above, are provided for each edge of the panel.

The frame members are connected to one another to form a rectangular subassembly. Next, a plurality of the clips are secured to each frame member. One such clip is inserted into an associated opening. Also, a selected one of the retaining strips is secured to each frame member by means of the clips secured to such frame member. Thus, a rectangular, partly assembly, panel-forming assembly is formed, into which the panel can be then inserted. The outer legs of the selected ones of the retaining strips are on one side of such assembly so as to confront one face of the panel along the panel edges when the panel is inserted into such assembly.

After the panel has been placed into that assembly the remaining ones of the retaining strips are secured to the assembly. This is done by securing the last-mentioned strips to the frame members by means of the clips secured to the frame members, so that the outer legs of the last-mentioned strips confront the remaining face of the panel, along the respective edges of the panel.

Via the preferred method described above, a rectangular, fully assembled, panel-framing assembly is formed, which frames the rectangular panel. The panel is retained by the outer legs of the retaining strips, along the respective edges of the panel, where the outer legs of the retaining strips confront the respective faces of the panel. No adhesive is required.

These and other objects, features, and advantages of this invention are evident from the following description of a preferred embodiment of this invention, with reference to the accompanying drawings.

BRIEF DESCRIPTION OF THE DRAWINGS

FIG. 5 shows one section of the panel-framing assembly in a partly assembled condition. FIG. 6 shows the same section in a fully assembled condition.

DETAILED DESCRIPTION OF PREFERRED EMBODIMENT

Figure 1:
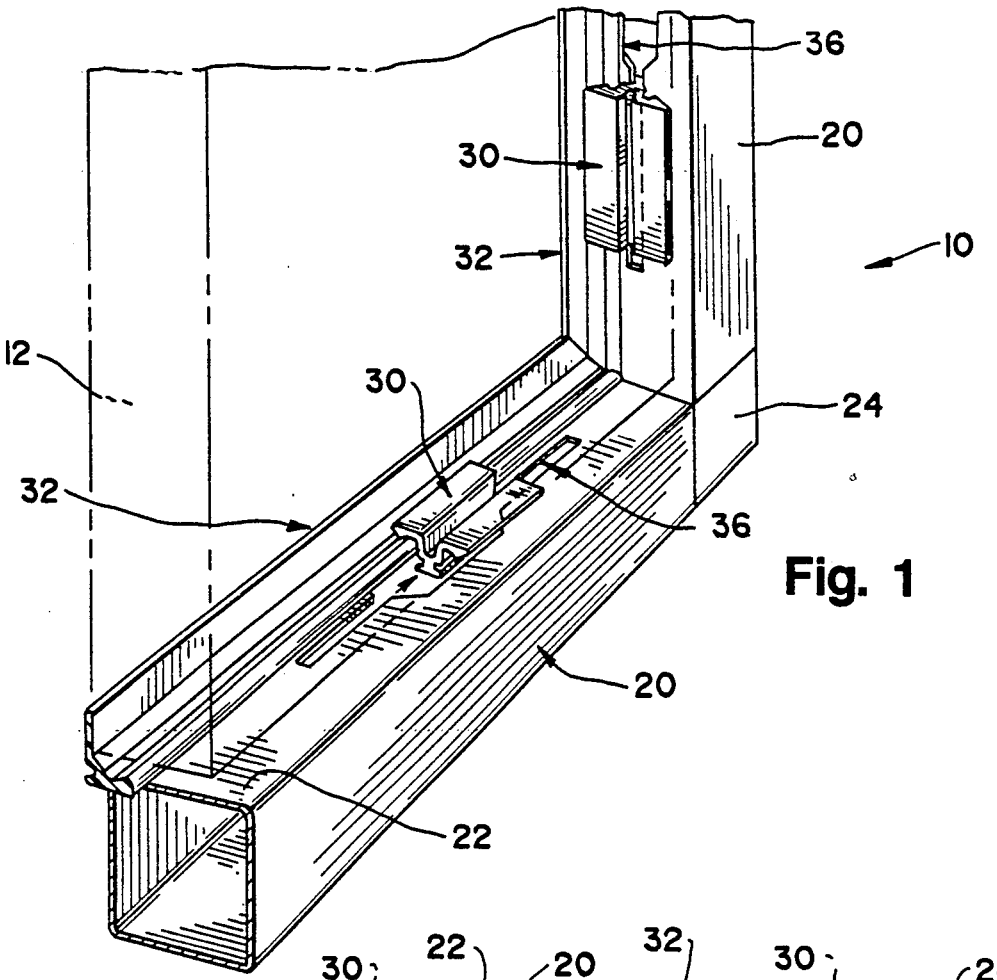
FIG. 1 is a fragmentary, perspective view of one corner of a partly assembled, panel-framing assembly constituting a preferred embodiment of this invention and being used to frame a panel, which is shown in phantom lines.

A presently preferred embodiment of this invention is illustrated in the drawings and will be hereinafter described. It should be understood, however, that this invention is not limited to any particular embodiment.

As shown in the drawings, a panel-framing assembly 10 constituting the preferred embodiment of this invention is used to frame a rectangular panel 12, which may be predominantly made of wood, wood byproducts, such as presswood or particle board, or another structural material. The panel 12 may be made of a sound-absorbing material.

Figure 2:
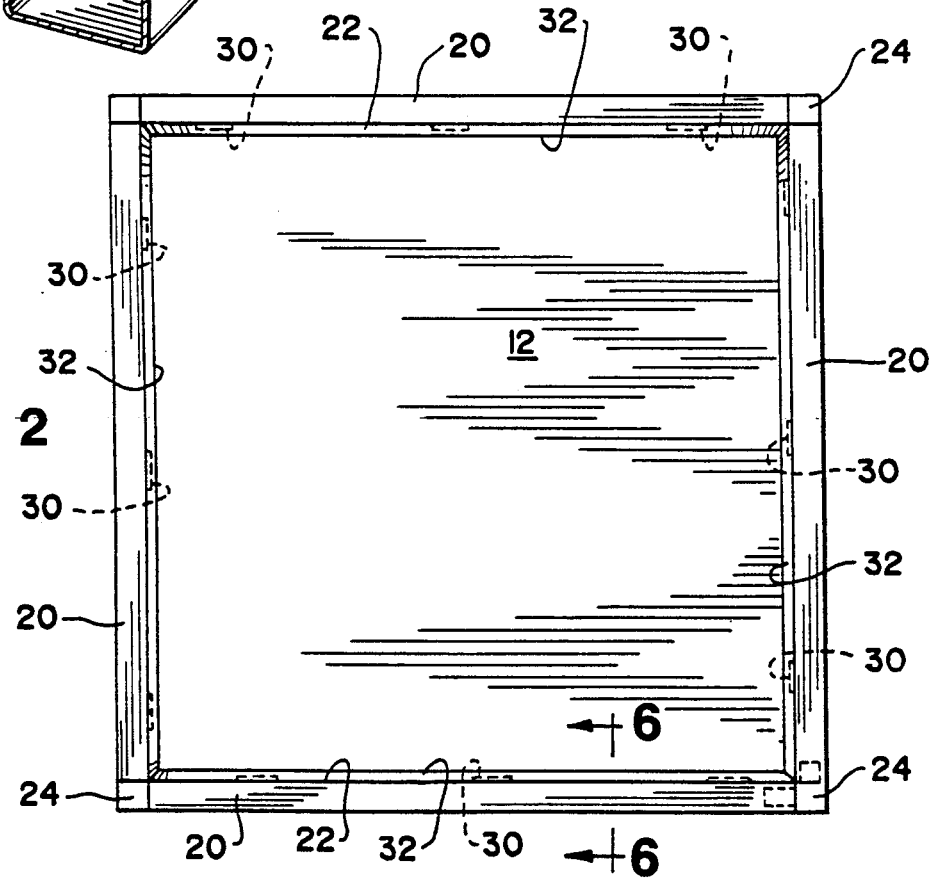
FIG. 2, on a smaller scale, is an elevational view of one face of the panel, as framed by the panel-framing assembly shown in FIG. 1.

The panel-framing assembly 10 comprises four frame members 20, each being a straight section of similar, hollow, substantially square, chrome-plated, steel tubing having an inner wall 22, which is flat. Also, the panel-framing assembly 10 comprises four similar corner connectors 24 having plugs (see the lower right hand corner of FIG. 2) of a known type useful with such hollow, substantially square tubing and made of chrome-plated steel. Each corner connector 24 connects two of the frame members 20, in a known manner, at each corner of the panel-framing assembly. Suitable corner connectors are exemplified in Reilly U.S. Pat. No. 3,532,369. Corner connectors 24 for connecting three orthogonally arranged frame members are well known and may be used where appropriate.

Moreover, the panel-framing assembly 10 comprises similar clips 30, which are formed, as by molding, from a polymeric material, nylon being a preferred material. Each clip 30 is cut to a suitable length. Three clips 30 are secured, in a manner to be later described, to each frame member 20 in the illustrated embodiment.

Furthermore, the panel-framing assembly 10 comprises retaining or molding strips 32, which are extruded from a polymeric material, polyvinyl chloride being a preferred material. Each retaining or molding strip 32 is cut to a suitable length and is mitered at a 45° angle, as shown, at its opposite ends. Pairs of the retaining or molding strips 32 are secured via the clips 30, in a manner to be later described, to each frame member 20.

As representative examples of the frame members 20, the clips 30, and the retaining or molding strips 32 of the panel-framing assembly 10, one frame member 20, one clip 30, and a pair of the retaining or molding strips 32, which when assembled with two more clips 30 constitute a representative one of four sections of the panel-framing assembly 10, will be next described with reference to FIGS. 3 through 6. Such sections when combined with four corner connectors 24, as mentioned above, constitute the panel-framing assembly 10.

Figure 3:
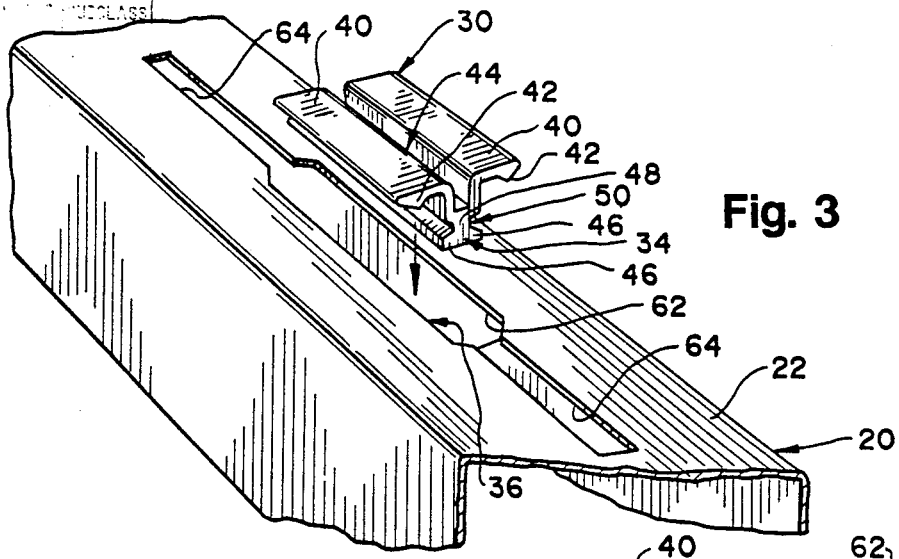
FIG. 3, on a larger scale, is a fragmentary, perspective, exploded view of two components of one section of the panel-framing assembly, namely a frame member and a clip.

As shown in FIG. 3, the clip 30 has a securing portion 34, which is insertable, in a direction normal to the wall 22, into an opening 36 defined in the wall 22. The clip 30 is adapted to coact with the wall 22, so as to secure the clip 30 to the frame member 20, after the securing portion 34 of the clip 30 has been inserted into the opening 36.

The clip 30 also has a flanged portion, which comprises a pair of seating flanges 40 confronting the wall 22, in spaced relation to the wall 22, after the clip 30 has been secured to the frame member 20. Each of the seating flanges 40 has a locking rib 42. The clip 30 has a groove 44 between the seating flanges 40 as shown, so as to facilitate extruding the clip 30 and to accommodate flexing of the flanges 40 when the molding or retaining strips 32 are to be secured thereto.

The securing portion 34 of the clip 30 includes a pair of securing flanges 46 extending along the opposite sides of the clip 30, and a web 48 connecting the securing flanges 46 to the seating flanges 40. The clip 30 defines a pair of oppositely facing grooves 50 between the securing flanges 46 and the seating flanges 40.

Figure 4:
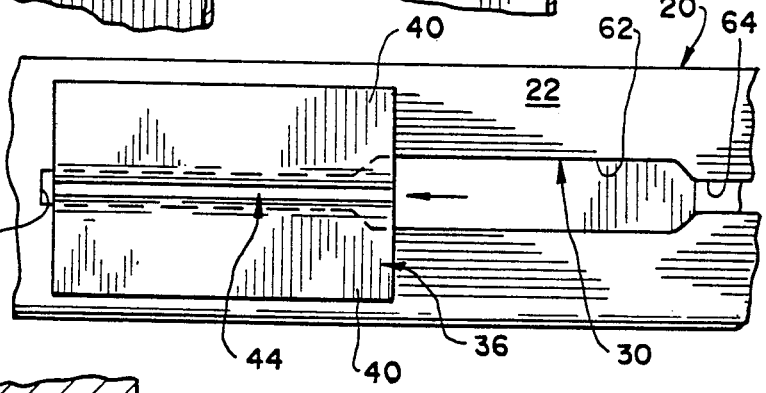
FIG. 4 is a fragmentary, plan view of FIG. 3, as assembled.

As shown in FIGS. 3 and 4, the opening 36 is elongated and slot shaped and extends longitudinally along the wall 22. The slot shaped opening 36 has a relatively wide region 62 and two relatively narrow regions 64, which respectively extend from opposite ends of the relatively wide region 62. One of the relatively narrow regions 64 may optionally be omitted from the opening 36.

The relatively wide region 62 is dimensioned to admit the securing flanges 46 when the securing portion 34 of the clip 30 is inserted as shown in FIG. 3, in a direction normal to the wall 22, into the relatively wide region 62 to assume a first position. Each of the relatively narrow regions 64 is dimensioned to admit the web 48 when the clip 30 is moved longitudinally along the wall 22, from the first position into a second position as shown in FIG. 4, in which the web 48 extends through one of the relatively narrow regions 64. When the clip 30 has been moved into the second position, portions of the wall 22 defining the relatively narrow regions 64 fit into grooves 50 and the securing flanges 46 coact with portions of the wall 22, so as to secure the clip 30 and to key it to the frame member 20. No adhesive is required.

As shown and described, each clip 30 is moved longitudinally within the elongated slot for such clip 30 when moved from the first position of such clip 30 to its second position, in which such clip 30 cannot be then withdrawn from the slot for such clip 30, in a direction normal to the wall 22 defining the slot.

As a first alternative (not shown) each clip and the opening for such clip may be respectively configured to permit each clip to be snap-fitted into the opening for such clip. As a second alternative (not shown) each clip and the opening for such clip may be respectively configured to permit such clip to be freely inserted into the opening for such clip, in a direction normal to the wall defining the opening, but to prevent such clip from being withdrawn from the opening for such clip, in an opposite direction, once such clip has been rotated within the opening, e.g., by one quarter-turn. No adhesive is required for either of the first and second alternatives noted above.

Figure 5:
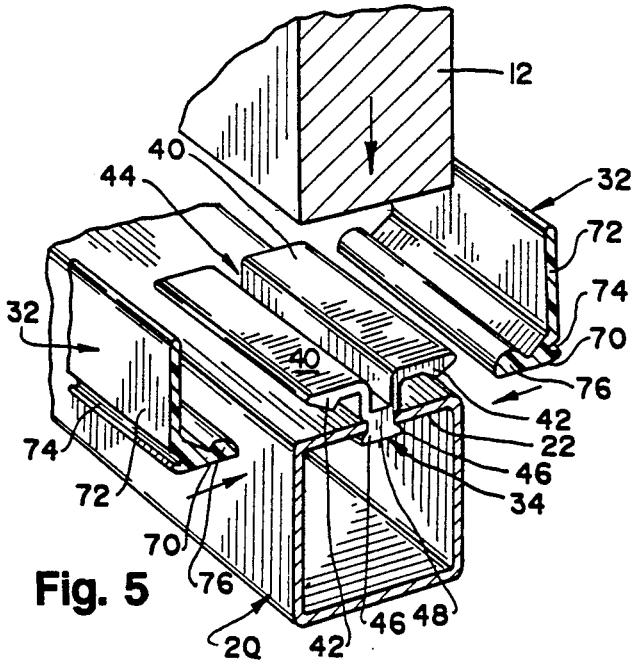
FIGS. 5 and 6 are fragmentary, perspective cross-sectional views taken along line 6—6 of FIG. 2, in a direction indicated by arrows, and turned slightly.
Figure 6:
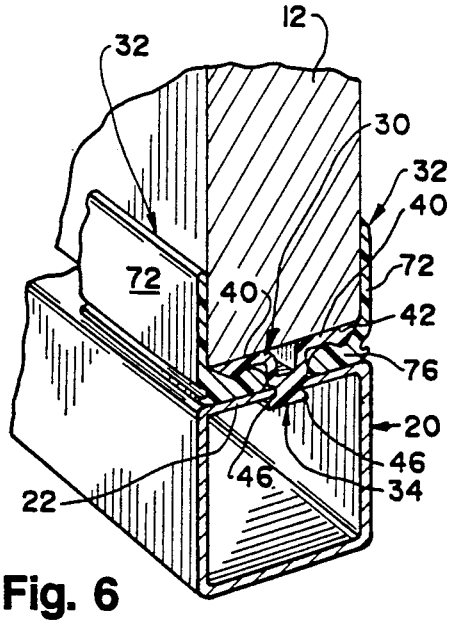

As shown in FIGS. 5 and 6, each retaining or molding strip 32 of the pair has an inner, horizontal leg 70 and an outer, vertical leg 72, which is generally normal to the inner leg 70. The strips 32 may also each be provided with a groove 74 facing outwardly, so as to enable the outer legs 72 to be somewhat flexible. The inner leg 70 of each retaining or molding strip 32 is insertable between a selected one of the seating flanges 40 of the flanged portion 38 of the clip 30 and the wall 22 when the clip 30 is secured to the frame member 20. Also, the inner leg 70 has an interlocking rib 76, which is adapted to be mechanically interlocked with the locking rib 42 of the selected one of the seating flanges 40 when the inner leg 70 is inserted therebetween (see FIG. 6).

The outer leg 72 of each retaining or molding strip 32 is adapted to retain the panel 12, which is seated against the seating flanges 40 of the flanged portion 38 of the clip 30, by engaging a portion of a respective face of the panel 12, along one edge of the panel 12, to prevent movement of the edge in a respective lateral direction relative to the frame member 20. The panel 12 should be suitably dimensioned to allow sufficient clearance for the inner leg 70 to be snap-fitted between the selected one of the seating flanges 40 and the wall 22 with the panel 12 seated against the seating flanges 40.

As shown in FIGS. 5 and 6, the retaining or molding strips 32 are installed respectively on opposite sides of the panel 12. No adhesive is required. Thus, the retaining or molding strips 32 retain the panel 12 along one edge of the panel 12, to prevent lateral movement of such edge in either direction relative to the frame member 20. Also, the retaining or molding strips 32 conceal any minor flaws along the panel edge, hence serving a trimming function.

Thus, in a presently preferred method according to this invention for framing the rectangular panel 12, four frame members 20, four corner connectors 24, three clips 30 for each frame member 20, and a pair of retaining or molding strips 32 for each frame member 20 are provided, each as described above.

The frame members 20 are connected to one another, by the corner connectors 24, to form a rectangular subassembly. Next, three clips 30 are secured to each frame member 20. One clip 30 is inserted into each opening 36 in the wall 22 of each frame member 20. Also, a selected one of the retaining strips 32 is secured to each frame member 20 by means of the clips 30 secured to such frame member 20. Thus, a rectangular, partly assembled, panel framing assembly is formed, into which the panel 12 can be then inserted. The outer legs 72 of the selected ones of the retaining strips 32 are on one side of such assembly so as to confront one face of the panel 12, along the respective edges of the panel, when the panel 12 is inserted into such assembly.

After the panel 12 has been placed into the assembly mentioned in the preceding paragraph, the remaining ones of the retaining strips 32 are secured to such assembly. This is done by securing the last-mentioned strips 32 to the frame members 20 by means of the clips 30 secured to the frame members 20, so that the outer legs 72 of the last-mentioned strips 32 confront the remaining face of the panel 12, along the respective edges of the panel 12.

As one possible modification (not shown) in the panel-framing assembly 10, the seating flanges of each clip may be somewhat thicker than the seating flanges of the clip 30. The thicker flanges are useful to compensate for minor variations in the height or width of the panel 12.

Various other modifications may be made in the panel-framing assembly 10 without departing from the scope and spirit of this invention.

I claim:

1. An assembly for framing a panel, the assembly comprising and being assembled from (a) a frame member having a wall defining an opening, (b) a clip having a securing portion inserted into the opening and coacting with the wall to secure the clip to the frame member after the securing portion has been inserted into the opening, the clip having a flanged portion confronting the wall, but in spaced relation to the wall after the clip has been secured to the frame member, and (c) a retaining strip having an inner leg and an outer leg which is generally normal to the inner leg, the inner leg being inserted between the flanged portion and the wall and being insertable therebetween after the clip is secured to the frame member, the inner leg coacting with the flanged portion to secure the retaining strip to the frame member by means of the clip, the outer leg being adapted to retain a panel seated against the flanged portion by engaging a portion of one face of the panel, along one edge of the panel, to prevent lateral movement of the edge in one direction relative to the frame member.

2. The assembly of claim 1 wherein the clip is movable from a first inserted position into a second secured position relative to the frame member while the securing portion remains inserted in the opening, and wherein the securing portion coacts with the wall to secure the clip to the frame member after the clip has been moved into the second position.

3. The assembly of claim 2 wherein the securing portion includes a securing flange and a web connecting the securing flange to the flanged portion, and wherein the opening comprises a slot extending longitudinally along the wall and having a relatively wide region in said first position and a relatively narrow region in said second position extending longitudinally from the relatively wide region, the securing portion being inserted into the relatively wide region to place the clip in the first position, the relatively wide region being dimensioned to admit the securing flange when the securing portion is inserted into the relatively wide region, the relatively narrow region being dimensioned to admit the web when the clip is moved longitudinally along the wall from the first position into the second position, in which the securing flange confronts the wall on one side of the relatively narrow region.

4. The assembly of claim 2 wherein the securing portion includes a pair of securing flanges and a web connecting the securing flanges to the flanged portion, the securing flanges extending from opposite sides of the web, and wherein the opening comprises a slot extending longitudinally along the wall and having a relatively wide region in said first position and a relatively narrow region in said second position extending longitudinally from the relatively wide region, the securing portion being inserted into the relatively wide region to place the clip in the first position, the relatively wide region being dimensioned to admit the securing flange when the securing portion is inserted into the relatively wide region, the relatively narrow region being dimensioned to admit the web when the clip then is moved longitudinally along the wall from the first position into the second position, in which each securing flange confronts the wall on one side of the relatively narrow region.

5. An assembly or framing a panel, the assembly comprising and being assembled from (a) a frame member having a wall defining an opening, (b) a clip having a securing portion inserted into the opening and coacting with the wall to secure the clip to the frame member after the securing portion has been inserted into the opening, the clip having a flanged portion comprising a pair of seating flanges confronting the wall, but in spaced relation to the wall after the clip has been secured to the frame member, and (c) a pair of retaining strips, each retaining strip having an inner leg and an outer leg which is generally normal to the inner leg, the inner leg of each retaining strip being inserted between a respective one of the seating flanges and the wall and being insertable therebetween after the clip is secured to the frame member, the inner leg of each retaining strip coacting with the respective one of the seating flanges to secure such retaining strip to the frame member by means of the clip, the outer leg of each retaining strip being adapted to retain a panel seated against the seating flanges by engaging a portion of one face of the panel, along one edge of the panel, to prevent lateral movement of the edge in one direction relative to the frame member.

6. The assembly of claim 5, wherein the clip is movable from a first inserted position into a second secured position relative to the frame member while the securing portion remains inserted in the opening, and wherein the securing portion coacts with the wall to secure the clip to the frame member after the clip has been moved into the second position.

7. The assembly of claim 6 wherein the securing portion includes a securing flange and a web connecting the securing flange to the flanged portion, and wherein the opening comprises a slot extending longitudinally along the wall and having a relatively wide region in said first position and a relatively narrow region in said second position extending longitudinally from the relatively wide region, the securing portion being inserted, in a direction normal to the wall, into the relatively wide region to place the clip in the first position, the relatively wide region being dimensioned to admit the securing flange when the securing portion is inserted into the relatively wide region, the relatively narrow region being dimensioned to admit the web when the clip is moved longitudinally along the wall from the first position into the second position, in which the securing flange confronts the wall on one side of the relatively narrow region.

8. The assembly of claim 6 wherein the securing portion includes a pair of securing flanges and a web connecting the securing flanges to the flanged portion, the securing flanges extending from opposite sides of the web, and wherein the opening comprises a slot extending longitudinally along the wall and having a relatively wide region in said first position and a relatively narrow region in said second position extending longitudinally from the relatively wide region, the securing portion being inserted in a direction normal to the wall, into the relatively wide region to place the clip in the first position, the relatively wide region being dimensioned to admit the securing flanges when the securing region is inserted into the relatively wide region, the relatively narrow region being dimensioned to admit the web when the clip is moved longitudinally along the wall from the first position into the second position, in which each securing flange confronts the wall on one side of the relatively narrow region.

9. The assembly of claim 5 wherein the wall of the frame member defines at least two such openings spaced longitudinally from one another, and wherein the assembly further comprises at least two such clips secured similarly in openings in the wall of the frame member.

10. The assembly of claim 9 comprising four such frame members connected to one another to form a rectangular frame, wherein at least two such clips are secured similarly to each such frame member of the rectangular frame, and wherein a pair of such retaining strips is secured similarly to each such frame member of the rectangular frame by means of the clips.

11. The assembly of claim 5 wherein each seating flange has a locking rib and the inner leg of each retaining strip has an interlocking rib which is adapted to coact with the locking ribs of the associated clips to secure such retaining strip to the frame member.

* * * * *